United States Patent [19]

Wiese

[11] 4,006,564

[45] Feb. 8, 1977

[54] FOLDABLE HAND RAIL AND SEATING STRUCTURE

[76] Inventor: Harold Wiese, North Highland, P.O. Box 236, Madison, S. Dak. 57042

[22] Filed: Jan. 21, 1976

[21] Appl. No.: 650,841

[52] U.S. Cl. ..... 52/9; 256/65

[51] Int. Cl.[2] ..... E04H 3/12

[58] Field of Search ..... 52/9, 8, 183; 256/59, 256/65

[56] References Cited

UNITED STATES PATENTS

| | | | |
|---|---|---|---|
| 3,401,918 | 9/1968 | Wiese | 52/9 X |
| 3,788,608 | 1/1974 | Raymond et al. | 52/9 X |
| 3,964,215 | 6/1976 | Hartman et al. | 52/9 |

*Primary Examiner*—Price C. Faw, Jr.
*Assistant Examiner*—Carl D. Friedman
*Attorney, Agent, or Firm*—Carl C. Batz

[57] ABSTRACT

A seating and hand rail structure which is foldable from a normal seating position into a folded storage position in which the rail as well as the seating structure is in a compact arrangement. The hand rail structure includes a plurality of upright posts which support the rail members. A rail member has its one end pivotally attached to one post and its other end pivotally attached to a slidable extension of a second post, the extension being movable upwardly of the second post when the structure comes toward the storage position. The rail member may be of telescoping sections which contract as the structure is brought toward storage position. A further feature is the provision of an automatic lock or preventing the upward movement of the extension when the seating is in extended position and automatic means for releasing the lock when the seating is moved toward storage position and the rail member pivoted to the extension has turned about its pivot to a predetermined degree.

12 Claims, 6 Drawing Figures

FOLDABLE HAND RAIL AND SEATING STRUCTURE

This invention relates to a foldable hand rail structure in combination with foldable seating structure. And more particularly, the invention deals with a hand rail structure which is attached to seating sections and which will fold into a compact arrangement when the seating sections are folded together.

BACKGROUND

The use of foldable seating sections for auditoriums, gymnasiums, and the like, is well known. The seating sections may normally be extended from the wall of the auditoriums to provide the normal bleacher facility, and when not in use may be folded back against the wall with each seating section, in turn, moving back under the former section toward the wall until all sections are together in compact arrangement just in front of the wall.

However, it is necessary to have the railing at the sides of the seating sections and this is where the problem arises. Ordinary railing structures will not fold and either have to be removed from the seating sections before folding or must in some way be made to fold along with the bleacher sections.

I have sought solutions to this problem and attempted to find effective foldable railing structures.

In my U.S. Pat. No. 3,401,918 I set forth structure in which a telescoping rail member is utilized, and in my patent application Ser. No. 404,994 filed Oct. 10, 1973, I set forth another special rail structure which is foldable along with the seating sections. However, one difficulty with all such foldable rail structures is that the distance between the ends of the rail is still greater than would be necessary to permit the rail structure to fold into a really compact arrangement with the rail elements stacked one over the other. Although the minimum length of the telescoped rail can be reduced by using a greater number of sections, there is a limit to the number of sections which can be used in the rail members, since a certain amount of overlapping of the sections is required.

I have discovered that such difficulty can be avoided by providing a special structure in which an end of the rail member is pivotally attached to an extension member of an upright post, with provision for such extension member to move to extend itself upwardly of the post so as to allow the rail member to fold into a more compact arrangement, and I have further discovered means for locking the rail member and the extension in their normal position when folding of the seat structures is in progress. An embodiment of these improved structures will be described in the following detailed description.

DESCRIPTION

A preferred embodiment of my invention is illustrated in the accompanying drawings in which.

Figure 1:
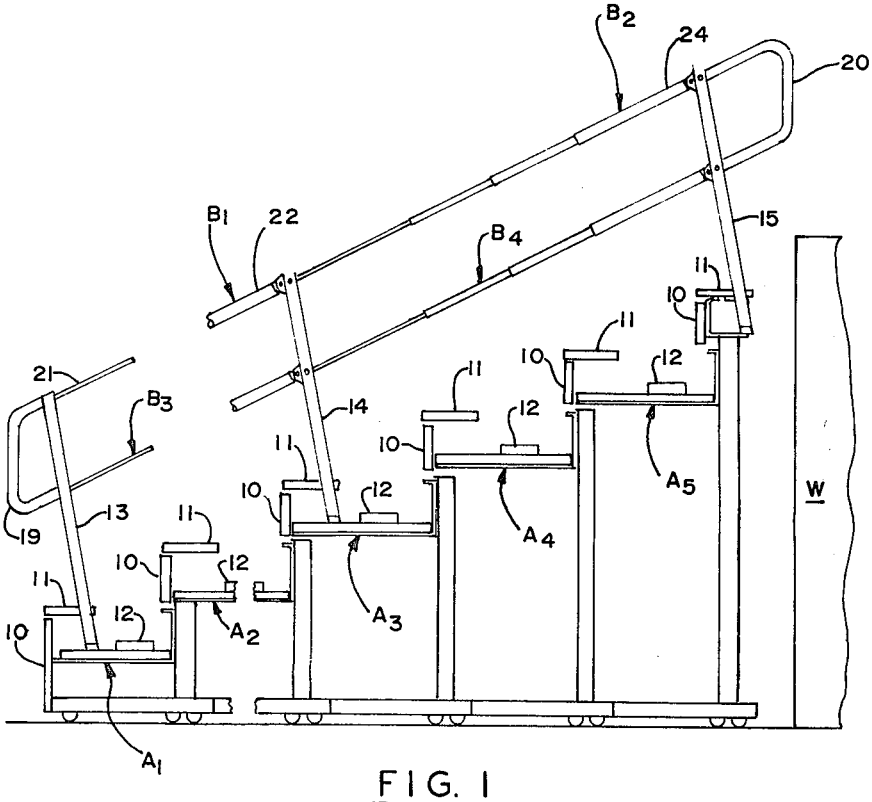
FIG. 1 is a view and side elevation of foldable seating sections and sections showing the hand rail in relation to such sections.
Figure 2:
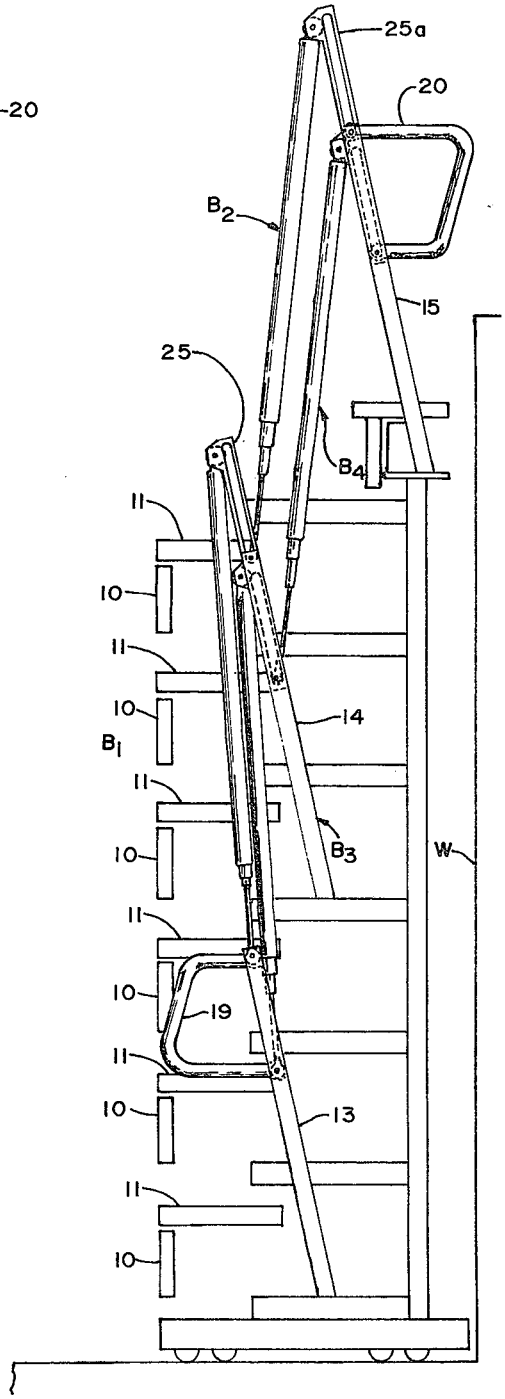
FIG. 2 is a side elevational view of the rail and seating sections in folded condition.

The general arrangement of the seating structure and the hand rail structure is best shown in FIG. 1. As illustrated, the seating structure is formed of sections $A_1$, $A_2$, $A_3$, $A_4$, and $A_5$, and the rail structure comprises rail members $B_1$ and $B_2$. In FIG. 1 the seating sections are shown in their extended or normal position for use. These sections have risers 10, seats 11, and foot rests 12. The folded position of the seating sections and the rail members is illustrated in FIG. 2 where the risers 10 provide a substantially vertical wall in front of the building wall W.

My improved structure includes two or more upright posts 13, 14 and 15 and which have their lower ends attached to spaced seating sections. These posts extend from their respective seating sections in a generally upward direction and may be described as upright or substantially vertical. It is not necessary that they be precisely vertical and they may be somewhat inclined toward the front as shown in FIG. 1. These posts serve as supports for the rail members. The post 13 is attached to a seating section at a lower level while posts 14 and 15 are attached to seating sections at respectively higher levels. These posts may suitably be formed of tubular metal having a square cross-section.

The attachment of the posts 13, 14 and 15 to the seating section may be made in any suitable way such as by using bolts or screws, and the attachment may be made either to the top surface of the seats or at the end of the seats. I prefer to use three or more of such posts but the invention may be utilized in connection with two posts.

The hand rail members, $B_1$ and $B_2$ are each formed of telescoping tubing. Each of these members have one section which is largest in diameter, another section which is smaller in diameter and which slides into the largest section, and there are other sections which slide respectively into the next larger section, etc. The rail member $B_1$ has its end 21 of smallest diameter connected to post 13 and its end 22 of largest diameter connected to post 14; and the rail member $B_2$ has its end 23 of smaller diameter connected to post 14 and its end 24 of largest diameter connected to post 15. The rail members illustrated are formed of four sections in telescoping relationship, but any number of two or more such sections may be used.

Other rail members $B_3$ and $B_4$ are connected to the posts 13, 14, 15, in the same manner as sections $B_1$ and $B_2$ but at a lower level on the post. A handle 19 is attached at the front side of post 13, and a handle 20 is attached at the rear side of post 15. The handle 19 and the lower ends of rail sections $B_1$ and $B_3$ are attached by passing pins through the posts and through the ends of the rail members and then through the ends of the handle 19. This provides a pivotal connection of the ends of the rail members. The upper ends of rail members $B_2$ and $B_4$ are similarly attached to posts 15.

Figure 4:
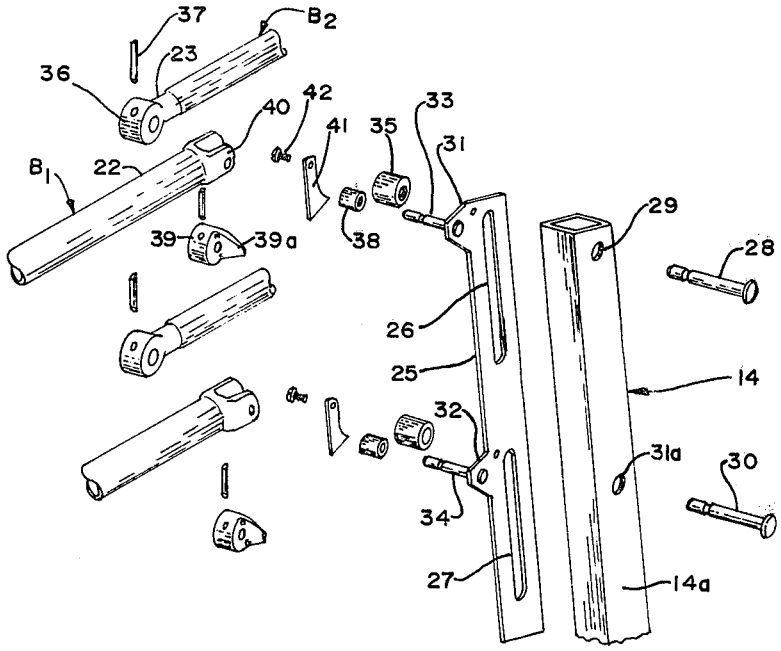
FIG. 4 is a schematic view of a post and its connection with the rail members, the parts being separated to better show their relationship.

The post 14 is of special construction in that it includes the extension 25 which is an elongated plate containing longitudinal slots 26 and 27. Referring to FIG. 4 the extension 25 is shown as on the back side of post 14 and the pin 28 may pass through the hole 29 and through the slot 26. Similarly, the pin 30 may pass through the hole 31 and through slot 27. With this arrangement the extension 25 is free to slide up and down with respect to the main body of the post 14 with the pins 28 and 30 moving along the slots 26 and 27 respectively. The extension 25 is provided at its front edge with the lugs 31 and 32. The pin 33 extends through a hole in lug 31 and the pin 34 extends through a hole in lug 32.

Figure 5:
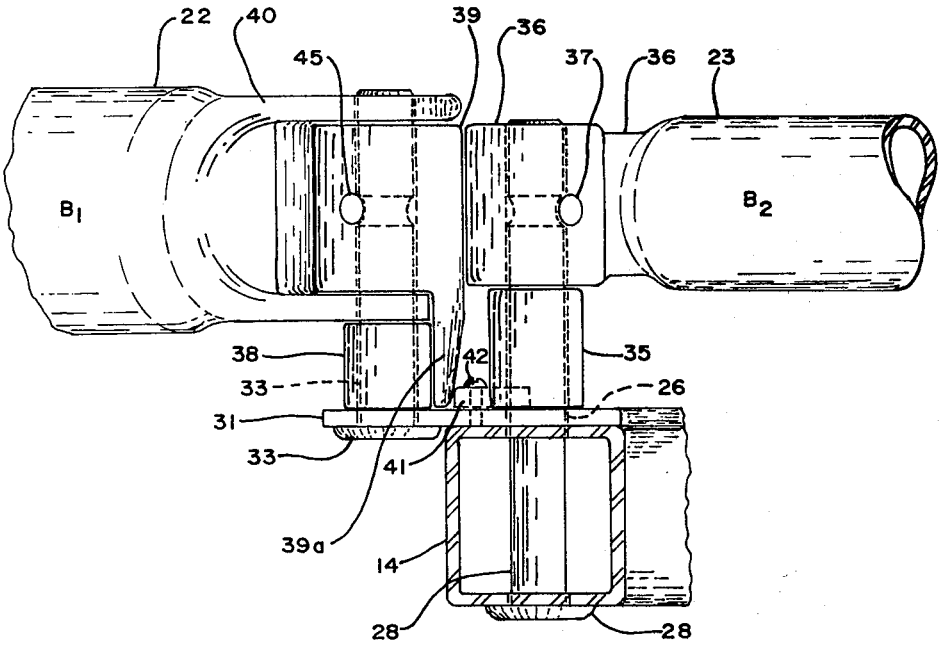
FIG. 5 is a detailed plan view showing parts of the locking mechanism.

The connection of the rail members to post 14 will now be described with particular reference to FIGS. 4 to 6.

The pin 28, after passing through hole 29 and slot 26 of the extension, passes through the spacer 35 and then the opening in the knuckle 36 at the end 23 of the rail member $B_2$. A key 37 extends into knuckle 36 and into a channel in pin 28 to hold the pin but still permit independent pivotal movement of the rail member.

The filler block 39 has an opening therethrough and fits between the sides of the knuckle 40 on the end 22 of rail member $B_1$. This fitting is such that the filler block moves along with the knuckle. Alternately, the filler block and the knuckle may be formed in one piece. With the filler block in place between the sides of the knuckle the pin 33, which has been passed through spacer 38, may be passed through the opening in the assembled knuckle 40 and filler block 39 and the key 45 inserted into a channel in pin 33 to lock the pin in place but permitting pivotal movement of the rail member about the shaft of the pin.

A locking lever 41 is pivotally mounted on the back side of extension 25 by means of the pivot pin 42. When this lever is pressed from the front its hook shaped lower end engages the bottom of the spacer 35 to lock the extension 25 against movement upwardly of the post 14.

The filler block 39 has a side extension **39*a* which extends to a position just in front of lever 41. The face of extension 39*a* is in the shape of a cam, so that when the extension is in its lowered position on post 14 and the rail members $B_1$ and $B_2$ are aligned, the cam engages the lever 41 and holds it with its hooked portion under the spacer 35. This is the condition illustrated in FIGS. 5 and 6. However, should the rail member be pivotally turned about pin 33 so that on their undersides the rail members may make with each other some angle less than 180°, for example, 160° or 135°, the cam face of extension 39*a* will have moved to remove pressure from lever 41 allowing the spacer to pass by lever 41 and allowing the spacer, along with other parts connected by pin 33, to move upward onto post 14**.

Figure 6:
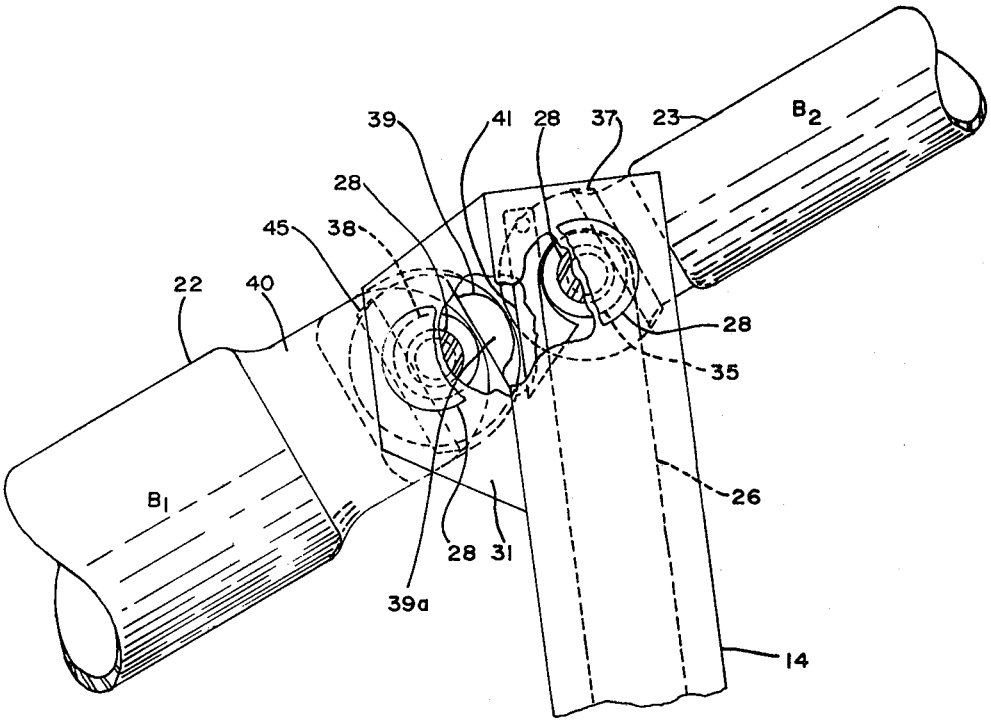
FIG. 6 is a detailed view in side elevation showing structures involved in the locking mechanism.

In FIG. 6 a window has been made to permit viewing of the cam portion of extension **39*a* and its contact with the front edge of lever 41. It can be seen in this figure how, if the rail member $B_1$ is moved pivotally downwardly, the cam will be removed from the lever 41**.

The connections of rail members $B_1$ and $B_2$ with the base of post 14 and with the extension 25 have been described in detail, and the same type of connections are employed in connecting rail member $B_3$ to the extension 25 and in connecting rail member $B_4$ to the base of post 14. Further, these same type of connections are employed to connect rail members $B_2$ and $B_4$ to the extension **25*a* of post 15, except that on the rear side of post 15 the handle 20** is connected instead of additional rail members.

OPERATION

We may start with a situation where the seating structure and the rail members are fully expanded as illustrated in FIG. 1. In this situation, the extensions of posts 14 and 15 are in their lower position with the cam face of the blocking member **39*a* pressing against the locking lever 41 to lock the extension 25 against upward movement with respect to the base 14*a* of the post 14. In this condition, the extension 25 of post 14 and the extension 25*a* of post 15** are fixed and cannot be moved upwardly of the posts. This means that the rail members may not be displaced or bumped out of position when the rail members are extended and the structure is ready for use.

Then when the seating structure is to be folded to a compact arrangement against the rear wall, motors may be started in operation which begin to pull back the seating section toward the rear wall. First the seating section which is farthest from the wall and which is the front or lowest of the seating sections, is moved back under the next adjacent section, and then this lowest section along with the adjacent section is moved back under the third lowest section, and so on, until the seats are completely folded.

We may remember that when this folding operation is begun, the rail members are locked at their upper ends with the stationary part of posts 14 and 15, but their lower ends are pivotally connected with the stationary part of the posts. This means that when rearward movement of the front seating sections is begun, the rail members $B_1$ and $B_3$ are shortened by operation of the telescoping of their sections and at the same time the rail members turn about the pivot pins 28 and 30.

Figure 3:
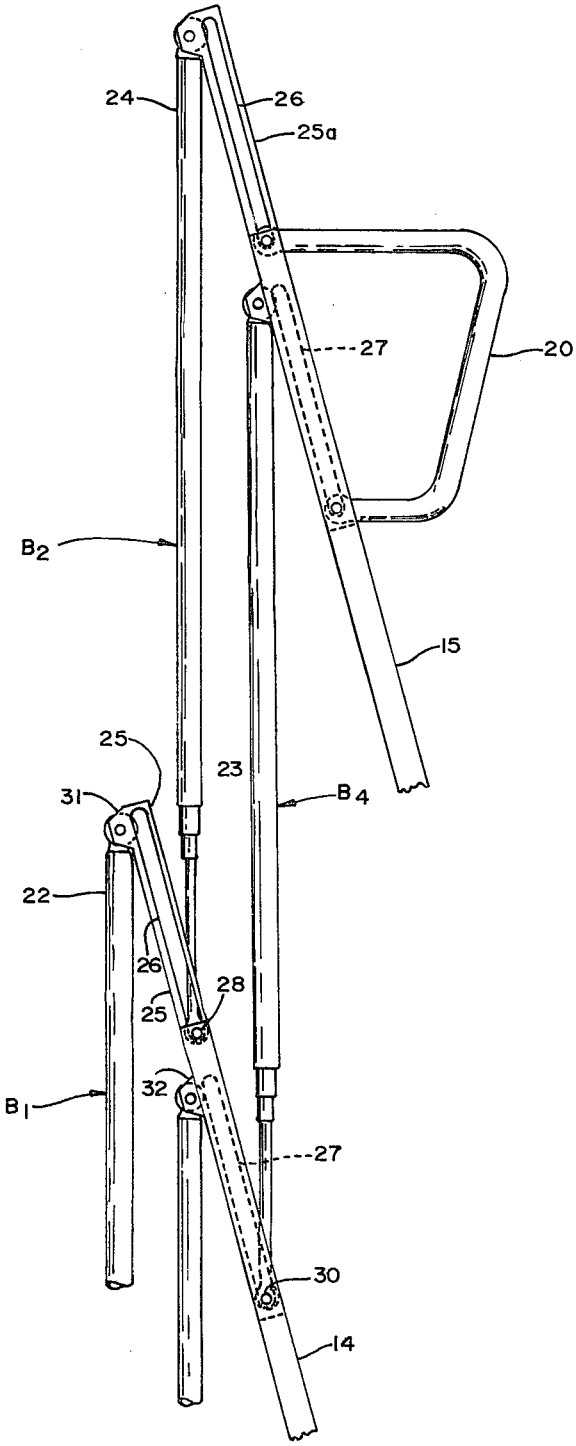
FIG. 3 is from the same point of view as FIG. 2 but shows one part of the rail structure substantially enlarged to better show the detailed construction.

The turning of the upper ends of the rail members $B_1$ and $B_3$ about their pivots turns the filler block 39 and the cam on its extension **39*a*, and when the cam is turned to the extent necessary to relieve its pressure on blocking lever 41 the extension 25 is unlocked so that when the rail members have contracted to the extent that they can, the extension 25 begins to move upwardly of post 14 with the pins 28 and 30 sliding in slots 26 and 27 of the extension. This continues until the post 13 and 14 comes substantially together, and when the seating section to which the post 14 is attached is pulled rearwardly this same operation is repeated with respect to rail members $B_2$ and $B_4$. At first there is the retraction of the telescoped sections of the rails which is accompanied by turning of the rail members about their upper ends to unlock the extension 25*a* and this is followed by movement of the extension upwardly of post 15. When the posts and rail members are completely folded they assume a position such as illustrated as in FIGS. 2 and 3** of the drawing.

The operation of my improved seating and rail structures when the seats and rail members are extended is substantially the reverse of that just described for the folding up operation. The extensions of post 15 move downwardly of the post, the telescoping sections of rails $B_2$ and $B_4$ move out and when the rail sections $B_2$ and $B_4$ are fully extended the extension **25*a* is automatically locked against upward movement. The extension 25 moves downwardly of post 14, these rail members are extended and when fully extended the cam face of 39*a* presses against the locking lever 41 to lock the extension 25*a* against movement upward of post 14**.

While I have described and illustrated in detail only a single embodiment of my improved seating and rail structures it will be apparent to those skilled in this art that many embodiments may be constructed and many changes may be made all within the spirit of the invention and the scope of the appended claims.

I claim:

1. A hand rail or the like in combination of multiple seating sections which fold from a normal seating configuration to a generally vertical storage position, comprising at least two spaced posts, means for attaching the lower ends of said posts to spaced seating sections, and a rail member having its one end pivotally connected to one of said posts, the second of said posts having an extension attached thereto which is movable upwardly of said second post, the other end of said rail member being pivotally connected to said extension, whereby when said one of said spaced seating sections is moved toward the other said extension may move upwardly of said second post.

2. The combination as set forth in claim 1 in which said rail member includes a plurality of telescoping tubular sections whereby when said seating sections are folded toward said generally vertical position said rail member contracts in length and said extension moves upwardly of said second post.

3. The combination set forth in claim 2 including means for locking said extension against movement upward of said second post, and means for unlocking said extension at or before the time said rail member reaches it minimum length.

4. A combination set forth in claim 3 in which said locking means is responsive to the angular position of said rail member about its pivot on said extension to lock said extension against upward movement.

5. A combination as set forth in claim 4 in which said locking means is also responsive to the angular position to said rail member about its pivot on said extension, for unlocking said extension.

6. A combination as set forth in claim 4 in which said locking means includes a lever pivotally mounted on said extension and means on an end of said rail member for engaging said lower level when said rail is in extended position to lock said extension against upward movement.

7. A combination as set forth in claim 6 in which said means on said rail member includes a cam surface which is positioned to engage said lever to lock said extension against upward movement when said rail member is in extended position.

8. A combination as set forth in claim 7 wherein said cam is so positioned so as to disengage with said lever when said rail member has been turned about its pivot on said extension by a predetermined amount.

9. A combination as set forth in claim 1 wherein said second post includes a base portion and an extension, said extension being attached to said base portion by means of a slot on said extension and a pin extending through said base portion and through said slot.

10. The combinations set forth in claim 1 in which said one post is attached by said means to a seating section at a lower level and said second post is attached to a seating section at a higher level whereby said seating section to which said posts are attached are moved together said second post will come into a position beneath said one post.

11. A combination as set forth in claim 1 which includes a third post having its end attached to one of said seating sections which is spaced from said second post, a second rail member having its one end pivotally connected to said second post, and an extension attached to said third post and movable upwardly of said third post, the other end of said second rail member being pivotally attached to said extension member which is attached to said third post, whereby when said seating sections are folded toward said generally vertical postion said extension which is attached to said third post moves upwardly to permit said rail members to be folded into said compact form.

12. A combination as set forth in claim 11 in which said third post has its extension attached to it by a pin in the post and in which said last mentioned extension has a slot, said pin engaging into the slot whereby to permit upward movement of said last mentioned extension with said pin moving along said slot.

* * * * *